United States Patent [19]

Faulkner

[11] Patent Number: 4,568,567

[45] Date of Patent: Feb. 4, 1986

[54] METHOD OF REMOVING TRACE QUANTITIES OF ALKALI METAL IMPURITIES FROM A BIALKALI-ANTIMONIDE PHOTOEMISSIVE CATHODE

[75] Inventor: Richard D. Faulkner, Manheim Township, Lancaster County, Pa.

[73] Assignee: RCA Corporation, Princeton, N.J.

[21] Appl. No.: 659,164

[22] Filed: Oct. 9, 1984

[51] Int. Cl.[4] ..... H01J 40/16

[52] U.S. Cl. ..... 427/74; 427/383.3; 445/11; 445/13; 445/17

[58] Field of Search ..... 427/74, 295, 124, 250, 427/383.3; 445/10–17

[56] References Cited

U.S. PATENT DOCUMENTS

| | | | |
|---|---|---|---|
| 2,431,401 | 11/1947 | Janes | 250/27.5 |
| 2,676,282 | 4/1954 | Polkosky | 313/102 |
| 2,770,561 | 11/1956 | Sommer | 117/211 |
| 2,877,078 | 3/1959 | Gauthier | 316/9 |
| 2,914,690 | 11/1959 | Sommer | 313/65 |
| 3,023,131 | 2/1962 | Cassman | 117/210 |
| 3,372,967 | 3/1968 | Hughes | 316/5 |
| 3,434,876 | 3/1969 | Stoudenheimer et al. | 117/211 |
| 3,535,011 | 10/1970 | Matheson et al. | 316/6 |
| 3,658,400 | 4/1972 | Helvy | 313/94 |
| 3,838,304 | 9/1974 | McDonie | 313/94 |
| 3,884,539 | 5/1975 | Sommer | 316/6 |
| 4,376,246 | 3/1983 | Butterwick | 250/207 |

OTHER PUBLICATIONS

A. Sommer, *Photoemissive Materials,* Wiley and Sons, Inc., 1968, pp. 113–124.

Electron Tube Division, RCA Corporation, *Electron Tube Design,* pp. 366–369, (1962).

*Primary Examiner*—Norman Morgenstern
*Assistant Examiner*—Kenneth Jaconetty
*Attorney, Agent, or Firm*—Eugene M. Whitacre; Dennis H. Irlbeck; Vincent J. Coughlin, Jr.

[57] ABSTRACT

A method of processing a bialkali-antimonide photoemissive cathode to remove trace quantities of alkali metal impurities is disclosed. The cathode is formed by heating alkali vapor sources comprising the chromates of two alkali materials which include trace impurities of two other alkali materials of higher vapor pressures than the aforementioned two alkali materials to sufficiently high temperatures to produce alkali vapors. The temperature of the substrate onto which the various alkali vapors condense is maintained at a sufficiently high temperature for a sufficiently long period of time to drive off the trace quantities of the higher vapor pressure other alkali materials from the substrate. Additionally, after the alkali vapor sources are heated to temperatures sufficient to vaporize the alkali chromates therein, the temperatures of the sources are lower and maintained at sufficient levels to accelerate the removal of reduced alkali vapors from the sources and from the photomultiplier tube.

1 Claim, 2 Drawing Figures

METHOD OF REMOVING TRACE QUANTITIES OF ALKALI METAL IMPURITIES FROM A BIALKALI-ANTIMONIDE PHOTOEMISSIVE CATHODE

BACKGROUND OF THE INVENTION

The invention relates to photoemissive cathodes and particularly to a method of removing trace quantities of cesium and rubidium from a potassium-sodium-antimony photoemissive cathode, which is the cathode of choice in many photomultiplier tubes used in high temperature environments.

In the present context, a trace quantity means an impurity level of a few tens of parts per million. Specifically, it has been determined that all commercially available sodium and potassium chromates which are evaporated to form sodium and potassium vapors, respectively, contain between 10 to 20 parts per million of both cesium and rubidium as impurities. Thus, if one were to attempt to form a potassium-sodium-antimony (bialkali-antimonide) photoemissive cathode using the above described chromates of potassium and sodium, the result would be a multi-alkali antimonide photoemissive cathode comprising predominently potassium, sodium and antimony with cesium and rubidium as unwanted trace inpurities. The presence of cesium and rubidium is thought to create small islands of multi-alkali antimonide photoemissive cathode which have higher dark current or higher noise than the surrounding bialkali antimonide photoemissive cathode comprising potassium-sodium-antimony.

It is known that the photoemissive cathode or photocathode of a photomultiplier tube is adversely affected by high operating temperatures. As the temperature of the tube increases, the dark current of the tube, particularly the thermionic component of the dark current, also increases, thus decreasing the signal-to-noise ratio of the tube. Thermionic emission generally originates from the photocathode itself or from other surfaces in the tube on which alkali materials have been deposited. Typically the photocathode is formed not only on the inside surface of the faceplate but also along the upper sidewall of the tube adjacent to the faceplate. Copending U.S. patent application Ser. No. 546,478, filed by R. D. Faulkner et al. on Oct. 28, 1983, entitled, "ELECTRON DISCHARGE DEVICE HAVING A THERMIONIC EMISSION-REDUCTION COATING," and assigned to the assignee of the present invention, discloses that an indium or induim oxide coating may be deposited along the sidewall to alloy with the constituents of the photocathode to form a high work function layer which is non-photoemissive and which has negligible thermionic emission over the operating temperature range of the tube. The Faulkner et al. copending patent application is incorporated by reference herein for the purpose of disclosure.

The Faulkner et al. patent application, however, offers no solution for lowering the dark current originating from the photocathode on the faceplate. It is known in the art to cool the photomultiplier tube and to reduce the thermionic emission by means of a cryostat; however, with some types of photocathodes, too low a temperature may result in the photocathode becoming so resistive that the photoemission is blocked by a drop in potential across the photoemissive surface. Since the dark current for a potassium-sodium-antimony bialkali photocathode operating at a temperature of 100° C. is about $4\times10^{-16}$ A/cm$^2$, whereas the dark current for a potassium-sodium-cesium-antimony multi-alkali photocathode is approximately $4\times10^{-12}$ A/cm$^2$, it is clearly beneficial to eliminate the residual impurities such as cesium and rubidium from the potassium-sodium-bialkali photocathode in order to reduce the dark current thereof. However, if lower acceptance levels for cesium and rubidium impurities in commerically purchased potassium and sodium chromates are established, the cost of the materials, and ultimately, the cost of the photomultiplier tube will be increased substantially. Accordingly, it is desirable to find alternative means for eliminating or reducing the trace quantities of cesium and rubidium that are present in the potassium-sodium-antimony photocathode in order to produce a tube having lower dark current.

SUMMARY OF THE INVENTION

A method of processing a bialkali-antimonide photoemissive cathode to remove trace quantities of alkali metal impurities is disclosed. The cathode is formed by heating alkali vapor sources, comprising the chromates of two alkali materials which include trace impurities of two other alkali materials of higher vapor pressures than the aforementioned two alkali materials, to sufficiently high temperatures to produce alkali vapors. The temperature of the substrate onto which the various alkali vapors condense is maintained at a sufficiently high temperature for a sufficiently long period of time to drive off the trace quantities of the higher vapor pressure other alkali materials from the substrate. Additionally, after the alkali vapor sources are heated to temperatures sufficient to vaporize the alkali chromates therein, the temperatures of the sources are lowered and maintained at sufficient levels to accelerate the removal of reduced alkali vapors from the sources and from the photomultiplier tube.

DETAILED DESCRIPTION OF THE PREFERRED EMBODIMENT

Figure 1:
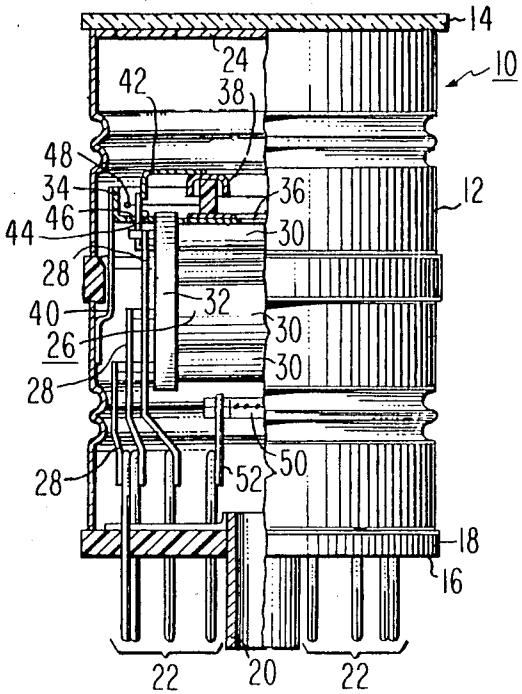
FIG. 1 is a partial broken away view of a photomultiplier tube in axial section having a photoemissive cathode made according to the novel method.

FIG. 1 shows a photomultiplier tube 10 comprising an evacuated envelope 12 having a generally cylindrical shape. The envelope 12 is closed at one end by a transparent faceplate 14 and at the other end by a stem section 16. The stem section 16 includes a ceramic base 18 having a centrally disposed metal tabulation 20 and a plurality of support leads 22 sealed therethrough. The metal tabulation 20 preferably is made from a copper alloy which is cold-welded after tube activation to form a vacuum seal.

A photoemissive cathode, hereinafter called the photocathode 24, is formed on the interior surface of the faceplate 14. A thermionic reduction coating (not shown), such as that described in the above-referenced copending U.S. patent application Ser. No. 546,478, may be provided on the interior sidewall of the envelope 12. The novel method of forming the photocathode 24 will be described hereinafter.

An electron multiplier cage assembly, indicated generally as 26, is supported within the envelope 12 by a plurality of cage leads 28 (only some of which are shown). The electron multiplier cage assembly 26 comprises a plurality of dynodes 30 and an anode (not shown) disposed between a pair of dynode support spacers 32 (only one of which is shown). The dynodes 30 comprise secondary emissive electrodes for propagating and concatenating electron emission from the photocathode 24 to the anode. For high temperature tube operation, dynodes formed from a beryllium copper alloy and having a beryllium-oxide secondary emissive surface are preferred. The cage leads 28 interconnect the dynodes 30 and the anode to the internally projecting stem leads 22.

The dynode support spacers 32 are attached to a support electrode 34 which is spaced from the faceplate 14. The support electrode 34 is preferably a cup-shaped conductive member having a substantially flat base and a centrally disposed aperture 36 extending therethrough. A focusing electrode 38 is disposed around the aperture 36 in the manner, and for the purpose described in U.S. Pat. No. 4,376,246, issued on Mar. 8, 1983, to Butterwick, which is incorporated by reference herein for the purpose of disclosure. Electrical connection to the support electrode 34 is provided by strap member 40 which is connected to the metal sidewall of the envelope 12. A connecting lead 42 is attached at one end to the focusing electrode 38 and at the other end to a stand-off electrode 44 extending through an insulated feedthrough 46 which is located in the base of the support electrode 34. The other end of the stand-off electrode 44 is connected by means of an electrical lead, not shown, to one of the support leads 22 extending through the base 18.

A pair of antimony evaporators 48 (only one of which is shown), each comprising a platinum-antimony alloy bead of about 50 percent antimony and 50 percent platinum, by weight, attached to a platinum-clad molybdenum wire filament, are disposed within the support electrode 34. A potassium vapor source 50, located between the electron multiplier cage assembly 26 and the stem section 16, comprises a retainer formed by spirally rolling a thin sheet of tantalum foil upon itself and spot welding the overlapping seams. The potassium source 50 contains potassium chromate, zirconium and tungsten within the retainer. The best commercially available potassium chromate is contaminated with trace quantities of cesium and rubidium alkali metals. Typically, the impurity concentrations of cesium and rubidium in the potassium chromate each range from about 10 to 20 parts per million. A second alkali vapor source, specifically a sodium source, not shown, is also disposed within the envelope 12. The sodium source also comprises a tantalum foil retainer containing, in this instance, sodium chromate, zirconium and tungsten. The sodium chromate is also contaminated with trace quantities of cesium and rubidium alkali metals in the concentration range of about 10 to 20 parts per million. Internal leads 52 (only one of which is shown) interconnect the potassium source 50 and the sodium source to different ones of the support leads 22 extending through the base 18. Suitable external electrical sources, not shown but well known in the art, are provided so that the alkali sources and the antimony evaporators can be activated separately by electrical resistance heating.

The photocathode 24 is made in accordance with the following procedure. The tubulation 20 is connected, prior to tip-off, to an exhaust system (not shown), and the tube envelope is exhausted until the pressure within the envelope 12 is of the order of $10^{-6}$ torr or less. The tube 10 is then baked at a temperature of about 425° C. for about 12 hours to remove occluded gases from the interior tube components. The tube is then cooled to room temperature (about 22° C.).

At room temperature, a thin film of antimony is deposited onto the interior surface of the faceplate 14 from the antimony evaporators 48. In order to form the antimony layer, a variable intensity light source (not shown) is arranged about the faceplate 14, and the light is directed into the tube to the flat surface of the support electrode 34. A photodetector and amplifying device (also not shown) are positioned above the faceplate to monitor the light reflected from the support electrode 34. The amplifying device includes a graduated dial which indicates a current flow proportional to the amount of reflected light from the light source that is incident on the photodetector. The indicator can be adjusted to show a full scale reading of 100 to indicate maximum light transmission through the faceplate 14. While the envelope is still evacuated, a current is passed through the antimony evaporators 48 to heat and evaporate antimony from the platinum-antimony beads. The antimony will condense upon the faceplate 14 to form a thin coating or base layer. The antimony is evaporated until the graduated dial indicator drops from an initial value of 100 to a value of 90. Since the light from the light source passes through the faceplate and antimony base layer twice before striking the photodetector, the actual value of the light transmission is half the dial indicator value after the antimony evaporation. In other words, if the dial indicator was initially set at 100 (100 percent transmission) before antimony was evaporated from source 48, then a final reading of 90 on the dial indicator shows that the light transmitted through the faceplate and antimony base layer is about 95 percent of the initial value.

During the subsequent processing steps, the responsivity of the photocathode 24 is monitored by collecting the emitted photoelectrons with one or more of the internal tube elements, such as the support electrode 34. Structures for monitoring photocathode responsivity are disclosed in U.S. Pat. No. 3,434,876 to Stoudenheimer et al. and U.S. Pat. No. 3,658,400 to Helvy which are incorporated herein for disclosure purpose. For such photoelectron collection, the electrode 34 is impressed with a voltage of between 50 and 150 volts positive with respect to the photocathode 24. A microammeter (not shown) is connected in series with the source of the voltage. Electrical connection to the photocathode 24 is made by attaching one lead to the metal sidewall of the tube adjacent to the faceplate 14 with the other lead attached to the lower portion of the metal sidewall adjacent to the stem section 16 which is connected to electrode 34 through connecting strap 40. A light source (not shown) is incident on the faceplate during the photocathode processing or sensitizing steps described hereinafter.

The tube 10 is heated to a temperature of 190° C. by lowering an oven (not shown) over the evacuated tube. When the tube temperature stabilizes at 190° C., the current through the potassium vapor source 50 is gradually increased to about 2.4 amperes to resistively heat the potassium vapor source 50 to a sufficiently high temperature to evolve potassium vapor as well as trace quantities of cesium vapor and rubidium vapor. The current through the potassium source 50 is adjusted to provide a potassium source temperature that results in a constant flow of predominantly potassium vapor as well as trace quantities of cesium vapor and rubidium vapor to the antimony base layer, and the responsivity is monitored. The responsivity, sometimes called the photoemissive sensitivity, of the photocathode is defined as the ratio of the output current of the photoemissive surface or device to the input flux in watts or lumens. For example, as applied to photomultiplier tubes, the radiant responsivity is expressed in milliamperes per watt (mA/W) at a specific wavelength, or luminous responsivity is expressed in microamperes per lumen (μA/lm). The potassium evaporation is continued until the responsivity of the resultant predominantly potassium-antimony photoemissive surface increases to a peak value and then decreases to about 95 percent of the peak value. At this point, the current through the potassium source 50 is turned off.

Next, the tube 10 is heated to a temperature ranging between 235° to 240° C. When the tube temperature stabilizes at 230° to 240° C., the current through the sodium vapor source is gradually increased to about 2.8 amperes to resistively heat the sodium source to a sufficiently high temperature until sodium vapor as well as trace quantities of cesium vapor and rubidium vapor are evolved. The current through the sodium source is adjusted to provide a sodium source temperature that results in a constant flow of sodium vapor as well as trace quantities of cesium vapor and rubidium vapor to the predominantly potassium-antimony photoemissive surface, and the responsivity is monitored. The sodium evaporation is continued until the responsivity of the resultant predominantly potassium-sodium-antimony (bialkali-antimonide) photocathode 24 increases to a peak value and then decreases to about 95 percent of the peak value. At this point, the evaporation current is reduced from about 2.8 amperes to about 1.4 amperes. Lowering the current through the sodium source lowers the temperature of the source, thus terminating the reduction of sodium chromate to sodium vapor. However, by maintaining a current flow through the sosium source, the temperature of the source is such that previously reduced alkali vapors within the source, including the predominant sodium vapor as well as the trace quantities of cesium vapor and rubidium vapor, generated by the reduction of the cesium and rubidium impurities in the sodium chromate, are removed from the sodium source and evacuated from the tube. Of course, some of the cesium vapor and rubidium vapor will migrate to the predominantly potassium-sodium-antimony photocathode 24 on the faceplate 14. In order to drive-off the unwanted cesium and rubidium from the predominantly potassium-sodium-antimony photocathode 24, the tube is baked at 235° to 240° C. for about 15 minutes. The vapor pressure of cesium at this temperature range is about 0.4 torr, and the vapor pressure of rubidium at this temperature is about 0.15 torr; whereas, the vapor pressure of sodium at the same temperature is about $10^{-3}$ torr and that of potassium is about $0.4\times10^{-2}$ torr. The higher vapor pressures of both cesium and rubidium mean that these materials will be baked-off or drawn-out from the photocathode 24 more rapidly than the predominant potassium and sodium. The resulting potassium-sodium-antimony photocathode 24 will be substantially free of trace amounts of cesium and rubidium. The current through the sodium source is reduced to zero after the 15 minute bake.

Next, with the temperature of the tube maintained within the range of 235° to 240° C., the current through the potassium vapor source 50 is gradually increased to about 2.3 amperes to resistively heat the potassium source to a sufficiently high temperature to evolve potassium vapor. The current through the potassium source is adjusted to provide a temperature that results in a constant flow of potassium vapor to the predominantly potassium-sodium-antimony photocathode 24. The responsivity of the photocathode 24 is monitored during the potassium evaporation step. The potassium evaporation is continued until the responsivity of the resultant predominantly potassium-sodium-antimony photocathode 24 reaches a peak value. At that point, antimony is evaporated from the antimony evaporators 48 onto the photocathode 24 until the responsivity of the photocathode 24 decreases to about 50 percent of the previously established potassium peak. The alternation of potassium and antimony is continued until a final peak value of responsivity is obtained, during a potassium evaporation step, that is lower than a previously obtained potassium peak. Then, additional potassium is added to further decrease the responsivity of the photocathode 24 to 95 percent of the last potassium peak. During the aforedescribed potassium-antimony alternations, the current to the potassium source 50 is turned off while antimony is being added to the photocathode 24. To evaporate potassium, the current is raised to about 2.3 amperes.

Next, the oven is turned off and allowed to slowly cool from the photocathode processing temperature of 235° to 240° C. When the temperature of the tube reaches 230° C., the responsivity of the photocathode is monitored and potassium is added by passing about 2.3 amperes of current through the potassium source 50. The potassium evaporation is continued until a new peak of responsivity is obtained. The monitoring of responsivity and the addition of potassium is repeated every ten degrees and again when the tube temperature reaches 190° C. When the tube reaches 190° C., the current flow through the potassium source 50 is reduced to about 1.0 amperes. The tube is further cooled to 175° C. and allowed to stabilize at that temperature. By reducing the current to 1.0 amperes, the temperature of the potassium source 50 is lowered, thus, terminating the reduction of potassium chromate to potassium vapor. However, by maintaining a current flow through the potassium source, the temperature of the source is such that the previously reduced alkali vapors within the source, including the predominant potassium vapor as well as trace quantities of cesium vapor and rubidium vapor, generated by the reduction of the cesium and rubidium impurities in the potassium chromate, are removed from the potassium source and evacuated from the tube. Some cesium and rubidium will migrate to the predominantly potassium-sodium-antimony photocathode 24; however, the higher vapor pressure cesium and rubidium will be driven-off from the photocathode by the subsequent processing steps.

At the end of the 15 minute hold period, the current through the potassium source is turned off. The tube is now baked at 175° C., while the responsivity of the photocathode 24 is monitored for an additional 2 hours or until the responsivity drops to 90 percent of its peak value at 175° C., whichever occurs first. Then the oven is raised slightly to accelerate the cooling to 75° C., at which point, the oven is raised completely and the tube is allowed to cool to room temperature.

Figure 2:
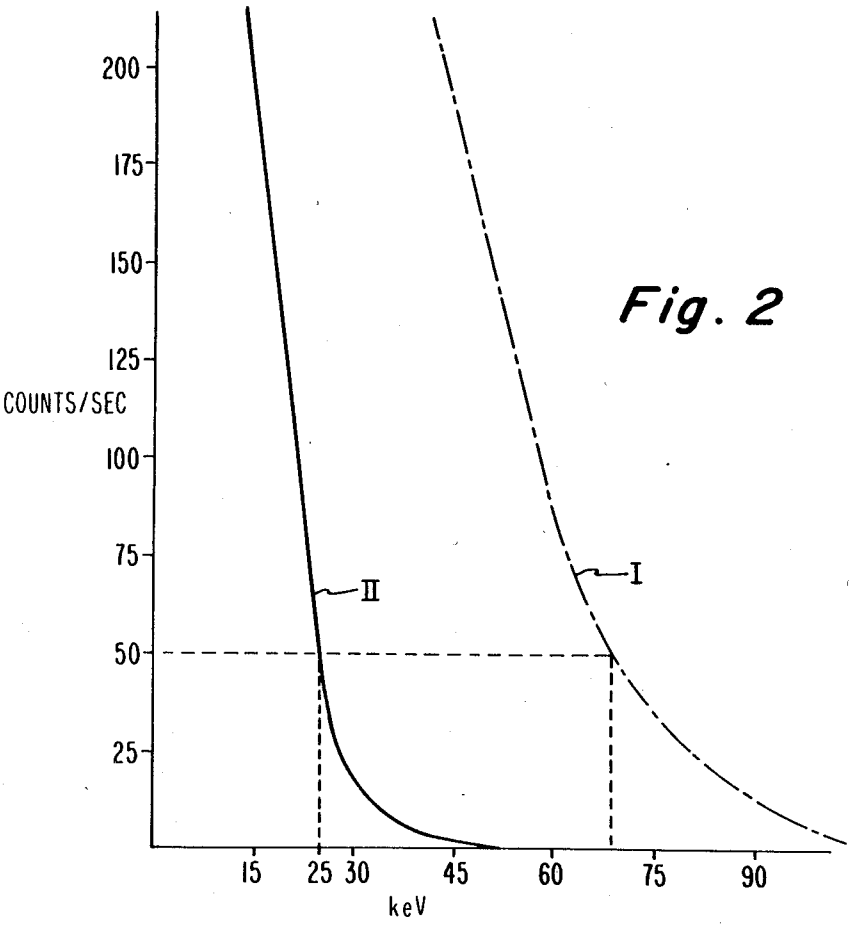
FIG. 2 is a graph indicating the background noise for a composite of conventional potassium-sodium-antimony photoemissive cathodes having trace amounts of cesium and rubidium therein, and a composite of potassium-sodium-antimony photoemissive cathodes made according to the novel method.

FIG. 2 shows a comparison of the noise performance of two groups of tubes. Curve I is a composite of tubes having potassium-sodium-antimony photocathodes processed according to the conventional method disclosed in U.S. Pat. No. 3,838,304, issued to McDonie on Sept. 24, 1974. Curve II is a composite of tubes processed by the present method which provides sufficiently high processing temperatures and long baking times to drive-off from the photocathode 24 the cesium and rubidium impurities which tend to increase the dark current of the tube.

All of the tubes tested to provide the curves shown in FIG. 2 had a thallium doped, sodium iodide crystal affixed to the outside surface of the faceplate, contiguous with the photocathode. Each tube was placed in an oven and the oven temperature was increased to 175° C. An operating voltage of 1500 volts was applied to the tube and the tube was allowed to stabilize at 175° C. The output of the tube was connected to a pulse-height analyzer. After the tube temperature stabilized, the analyzer was turned on for 100 seconds. The tube-crystal combination registered ambient radiation and tube noise at 175° C. The output was displayed on the CRT screen of the analyzer.

FIG. 2 shows a graph of energy plotted along the abscissa and counts per second plotted along the ordinate. As an arbitrary measure of tube performance at 175° C., the energy at 50 counts per second has been selected to define a "noise-edge". The tubes of composite curve I have conventionally processed photocathodes and typically have a 50 count per second noise-edge ranging from about 50 to 70 keV at 175° C. Composite curve II represents tubes made according to the novel process described herein which have potassium-sodium bialkali-antimonide photocathodes substantially free from cesium and rubidium impurities. These latter tubes have a 50 count per second noise edge ranging from 20 to 30 keV at 175° C. The reduction of the noise edge by a factor of about 2½ over conventionally processed tubes means that tubes having potassium-sodium-antimony photocathodes processed by the present novel method can operate at temperatures in excess of 175° C., with better noise performance than conventionally processed tubes operating at 175° C.

What is claimed is:

1. A method of eliminating trace quantities of cesium and rubidium from a potassium-sodium-antimony photoemissive cathode formed within an evacuated envelope including the steps of:

(a) forming a base layer including antimony on a substrate, (b) evaporating potassium vapor from a first source, along with trace quantities of the impurities including cesium and rubidium onto said base layer while said substrate is maintained at a temperature of about 190° C., until the responsivity of the resultant predominantly potassium-antimony photoemissive surface increases to a first peak value and then decreases to about 95 percent of the first peak value, (c) evaporating sodium vapor from a second source, along with trace quantities of the impurities including cesium and rubidium onto said potassium-antimony photoemissive surface while said substrate is maintained at a temperature ranging from 235° to 240° C., until the responsivity of the resultant predominantly potassium-sodium-antimony photoemissive cathode increases to a second peak value and then decreases to about 95 percent of the second peak value, (d) baking said predominantly potassium-sodium-antimony photoemissive cathode at a temperature ranging from 235° to 240° C., for about 15 minutes, in order to drive-out the trace quantities of the higher vapor pressure cesium and rubidium from the predominantly sodium-antimony photoemissive cathode, (e) re-evaporating potassium from said first source onto said predominantly potassium-sodium-antimony photoemissive cathode while said substrate is maintained at a temperature ranging from 235° to 240° C., such that the responsivity of the predominantly potassium-sodium-antimony photoemissive cathode increases to a third peak value, (f) depositing antimony onto said predominantly potassium-sodium-antimony photoemissive cathode while maintaining said substrate at a temperature ranging from 235° to 240° C., such that the responsivity of the predominantly potassium-sodium-antimony photoemissive cathode decreases to about 50 percent of said third peak value, (g) repeating steps (e) and (f) until a final value lower than the previously achieved peak value is obtained, and then continuing the evaporation of potassium until the responsivity of said potassium-sodium-antimony photoemissive cathode decrease to about 95 percent of the final value, (h) slowly reducing said substrate temperature while monitoring the responsivity of said predominantly potassium-sodium-antimony photoemissive cathode very 10 degrees C., (i) evaporating additional potassium from said second source onto said predominantly potassium-sodium-antimony photoemissive cathode every 10 degrees C., during step (h), so as to peak the responsivity of said cathode, (j) discontinuing the slow reduction of substrate temperature at 175° C., and maintaining the substrate at 175° C., for about 2 hours, or until the responsivity decreases from the peak value established at 175° C., to 90 percent of that peak value, thereby eliminating the trace quantities of cesium and rubidium from said cathode, and (k) slowly cooling said substrate to 75° C., and then rapidly cooling said substrate to about 22° C.

* * * * *